US006408438B1

(12) United States Patent
Mc Kee

(10) Patent No.: US 6,408,438 B1
(45) Date of Patent: Jun. 25, 2002

(54) ADJUSTABLE LENGTH GARMENT

(76) Inventor: Dale D. Mc Kee, 2071 Royal Fern La., Hoover, AL (US) 35244

( * ) Notice: Subject to any disclaimer, the term of this patent is extended or adjusted under 35 U.S.C. 154(b) by 0 days.

(21) Appl. No.: 09/822,139

(22) Filed: Mar. 30, 2001

(51) Int. Cl.[7] ..... A41D 27/08
(52) U.S. Cl. ..... 2/69; 2/244
(58) Field of Search ..... 2/69, 244, 105, 2/74, 160, 269

(56) References Cited

U.S. PATENT DOCUMENTS

| | | | | | |
|---|---|---|---|---|---|
| 706,235 | A | * | 8/1902 | Hermann | |
| 2,227,214 | A | * | 12/1940 | Bisberg | 2/243 |
| 2,688,136 | A | * | 9/1954 | Freedman | 2/105 |
| 2,724,120 | A | * | 11/1955 | Biern | 2/211 |
| 2,899,962 | A | * | 8/1959 | Entringer et al. | |
| 2,914,773 | A | | 12/1959 | Walter | |
| 3,665,516 | A | | 5/1972 | Orovan | |
| 3,701,166 | A | * | 10/1972 | Lindblom | 2/244 |
| 3,708,800 | A | | 1/1973 | Burton | |
| 3,848,271 | A | * | 11/1974 | Goele | 2/338 |
| 3,883,896 | A | | 5/1975 | Cain | |
| 4,215,435 | A | * | 8/1980 | Miele | 2/227 |
| 4,377,007 | A | * | 3/1983 | Sudjian | 2/105 |
| D295,112 | S | | 4/1988 | Viola | |
| 4,975,986 | A | * | 12/1990 | Strongwater | 2/160 |
| 5,173,965 | A | | 12/1992 | Panner | |
| 5,325,542 | A | * | 7/1994 | Lenerville | 2/244 |
| 5,416,928 | A | * | 5/1995 | Koenig | 2/244 |
| 5,894,600 | A | * | 4/1999 | Chenefront | 2/69 |

* cited by examiner

*Primary Examiner*—Gloria M. Hale
*Assistant Examiner*—Alissa L. Hoey

(57) ABSTRACT

A adjustable length garment for selectively extending the length and design of a garment. The adjustable length garment includes a main covering having a bottom edge. Each of a plurality of panels is generally tubular shaped and has a first edge and a second edge. Each of a plurality of connectors selectively connects each of the first edges to the bottom edge or the second edge. A first of the panels is coupled to the bottom edge of the main covering and a plurality of panels is coupled to each other and to the first panel to extend a length of the garment.

3 Claims, 7 Drawing Sheets

ADJUSTABLE LENGTH GARMENT

BACKGROUND OF THE INVENTION

1. Field of the Invention

The present invention relates to garments and more particularly pertains to a new adjustable length garment for selectively extending the length and design of a garment.

2. Description of the Prior Art

The use of garments is known in the prior art. More specifically, garments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,708,800; U.S. Pat. No. 3,665,516; U.S. Pat. No. 3,883,896; U.S. Pat. No. 2,914,773; U.S. Pat. No. 5,173,965; and U.S. Des. Pat. No. 295,112.

While these devices fulfill their respective, particular objectives and requirements, the aforementioned patents do not disclose a new adjustable length garment. The inventive device includes a main covering having a bottom edge. Each of a plurality of panels is generally tubular shaped and has a first edge and a second edge. Each of a plurality of connectors selectively connects each of the first edges to the bottom edge or the second edge. A first of the panels is coupled to the bottom edge of the main body and a plurality of panels is coupled to each other and to the first panel to extend a length of the garment.

In these respects, the adjustable length garment according to the present invention substantially departs from the conventional concepts and designs of the prior art, and in so doing provides an apparatus primarily developed for the purpose of selectively extending the length and design of a garment.

SUMMARY OF THE INVENTION

In view of the foregoing disadvantages inherent in the known types of garments now present in the prior art, the present invention provides a new adjustable length garment construction wherein the same can be utilized for selectively extending the length and design of a garment.

The general purpose of the present invention, which will be described subsequently in greater detail, is to provide a new adjustable length garment apparatus and method which has many of the advantages of the garments mentioned heretofore and many novel features that result in a new adjustable length garment which is not anticipated, rendered obvious, suggested, or even implied by any of the prior art garments, either alone or in any combination thereof.

To attain this, the present invention generally comprises a main covering having a bottom edge. Each of a plurality of panels is generally tubular shaped and has a first edge and a second edge. Each of a plurality of connectors selectively connects each of the first edges to the bottom edge or the second edge. A first of the panels is coupled to the bottom edge of the main body and a plurality of panels is coupled to each other and to the first panel to extend a length of the garment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable length garment apparatus and method which has many of the advantages of the garments mentioned heretofore and many novel features that result in a new adjustable length garment which is not anticipated, rendered obvious, suggested, or even implied by any of the prior art garments, either alone or in any combination thereof.

It is another object of the present invention to provide a new adjustable length garment which may be easily and efficiently manufactured and marketed.

It is a further object of the present invention to provide a new adjustable length garment which is of a durable and reliable construction.

An even further object of the present invention is to provide a new adjustable length garment which is susceptible of a low cost of manufacture with regard to both materials and labor, and which accordingly is then susceptible of low prices of sale to the consuming public, thereby making such adjustable length garment economically available to the buying public.

Still yet another object of the present invention is to provide a new adjustable length garment which provides in the apparatuses and methods of the prior art some of the advantages thereof, while simultaneously overcoming some of the disadvantages normally associated therewith.

Still another object of the present invention is to provide a new adjustable length garment for selectively extending the length and design of a garment.

Yet another object of the present invention is to provide a new adjustable length garment which includes a main covering having a bottom edge. Each of a plurality of panels is generally tubular shaped and has a first edge and a second edge. Each of a plurality of connectors selectively connects each of the first edges to the bottom edge or the second edge.

A first of the panels is coupled to the bottom edge of the main body and a plurality of panels is coupled to each other and to the first panel to extend a length of the garment.

Still yet another object of the present invention is to provide a new adjustable length garment that allows a user to either change the length and/or add braiding to an outfit in order make a variety of different outfits and coordinating accessories.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
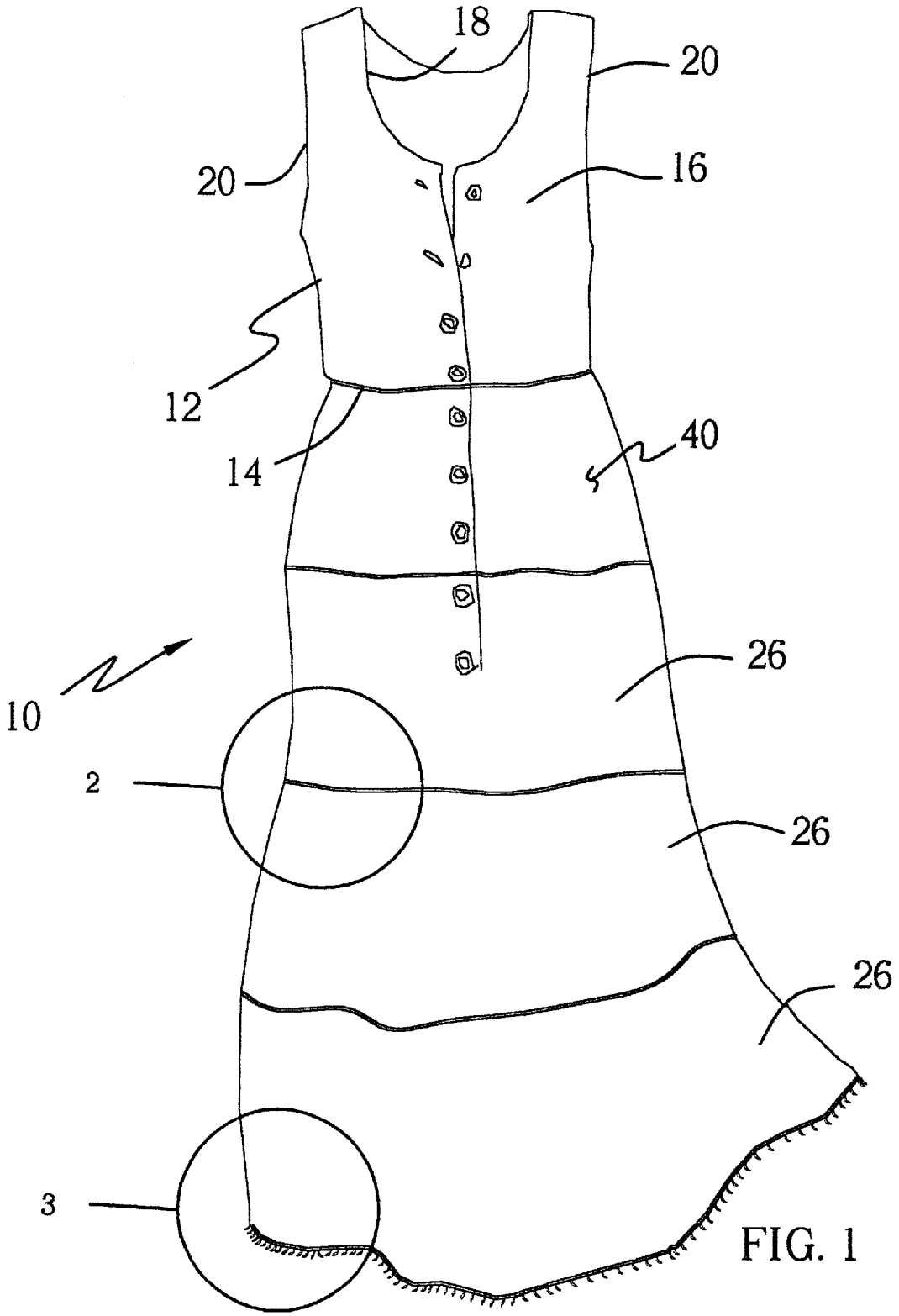
FIG. 1 is a schematic front view of the first embodiment a new adjustable length garment according to the present invention.
Figure 2:
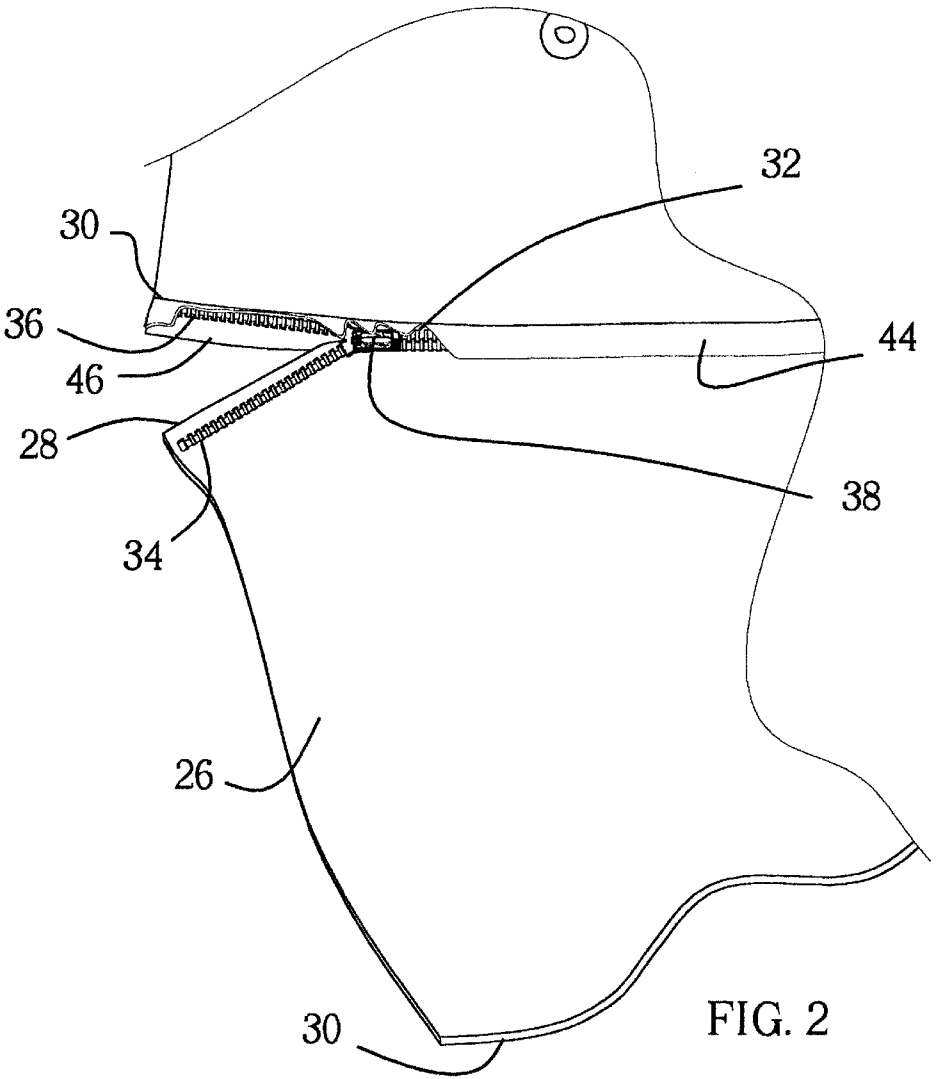
FIG. 2 is a schematic exploded view of the present invention.

With reference now to the drawings, and in particular to FIGS. 1 through 7 thereof, a new adjustable length garment embodying the principles and concepts of the present invention and generally designated by the reference numeral 10 will be described.

As best illustrated in FIGS. 1 through 7, the adjustable length garment 10 generally comprises a main covering 12. The main covering 12 has a bottom edge 14. The main covering 12 in FIG. 1 defines a torso portion 16 having a neck opening 18 and a pair of arm openings 20. The main covering 12 in FIG. 6 defines a glove having a palm portion 22 a plurality of fingers 24.

Each of a plurality of panels 26 is generally tubular shaped and has a first edge 28 and a second edge 30. Each of a plurality of connectors 32 selectively connects the first edges 28 to the bottom edge 14 or the second edge 30. Each of the connectors 32 traverses around each of the first edges 28, second edges 30 and bottom edge 14. Each of the connectors 32 comprises a first zipper portion 34 and a second zipper portion 36. Each of the first zipper portions 34 has a tab 38 thereon for releasably joining the first zipper portion 34 to one of the second zipper portions 36. Each of the first zipper portions 34 is securely attached to one of the first edges 28 of the panels 26. Each of the second zipper portions 36 is securely attached to one of the second edges 30 and the bottom edge 14. A first of the panels 40 is coupled to the bottom edge 14 of the main body 12 and a plurality of panels 26 is coupled to each other and to the first panel 40 to extend a length of the garment 10. Each of the panels 26 may have a different length between the first 28 and second 30 edges. Each of the panels 26 has a break 42 therein extending between the first 28 and second 30 edges.

Each of plurality of flanges 44 is coupled to an outer surface of one of the panels 26 and the main covering 12. Each of the flanges 44 is adjacent to and extends along the second zipper portions 36 and substantially covers an outer surface of the second zipper portions 36.

Each of a plurality of lips 46 is coupled to an inner surface of one of the panels 26 and the main covering 14. Each of the lips 46 is adjacent to and extends along the second zipper portions 36 and substantially covering an inner surface of the second zipper portions 36. The flanges 44 help to hide the zipper portions 34, 36 while the lips 46 protect the skin of the wearer from the zipper portions. The lips 46, flanges 44, panels 26, and main covering 14 are made from a cloth material.

Figure 3:
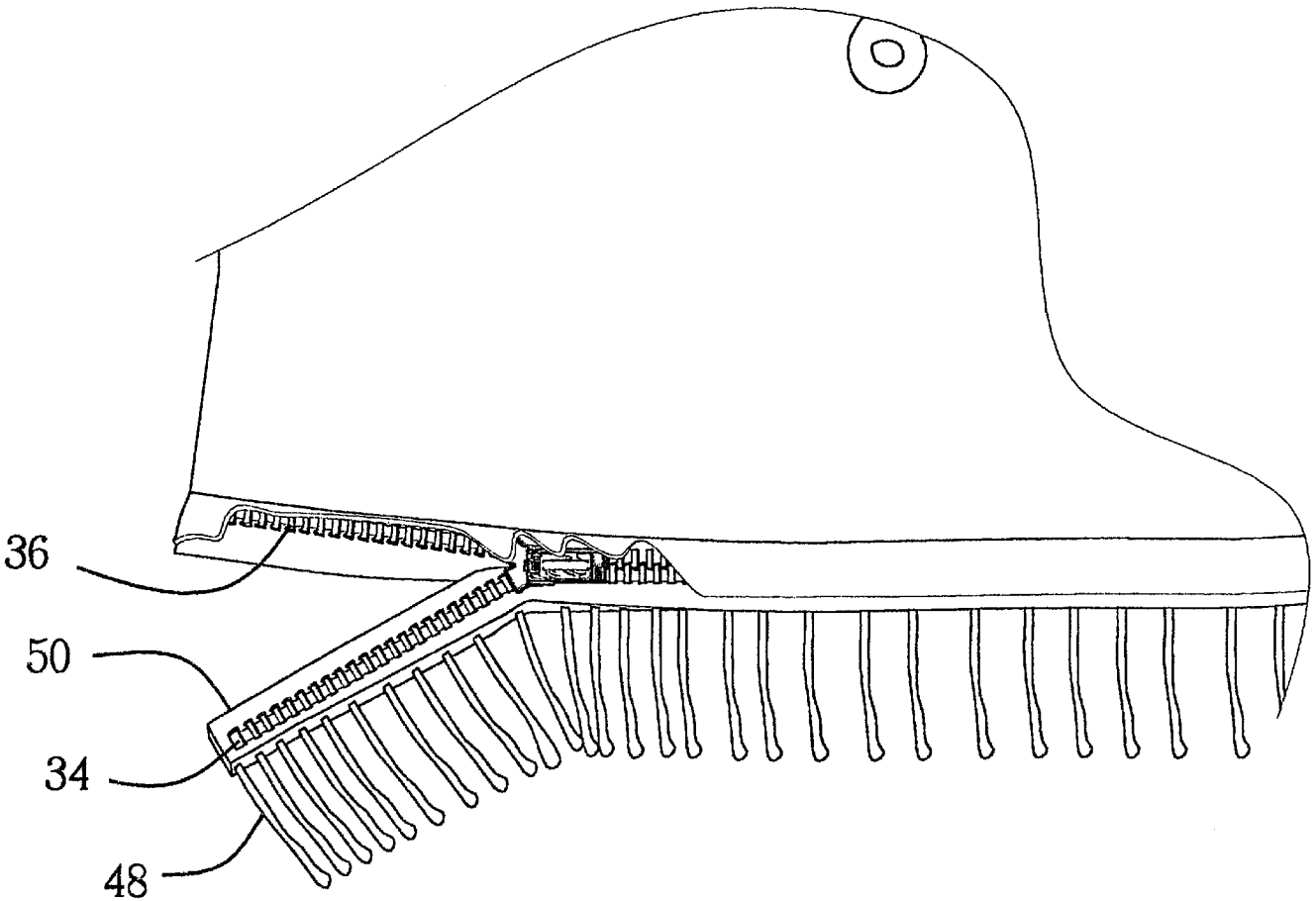
FIG. 3 is a schematic exploded view of the present invention.
Figure 4:
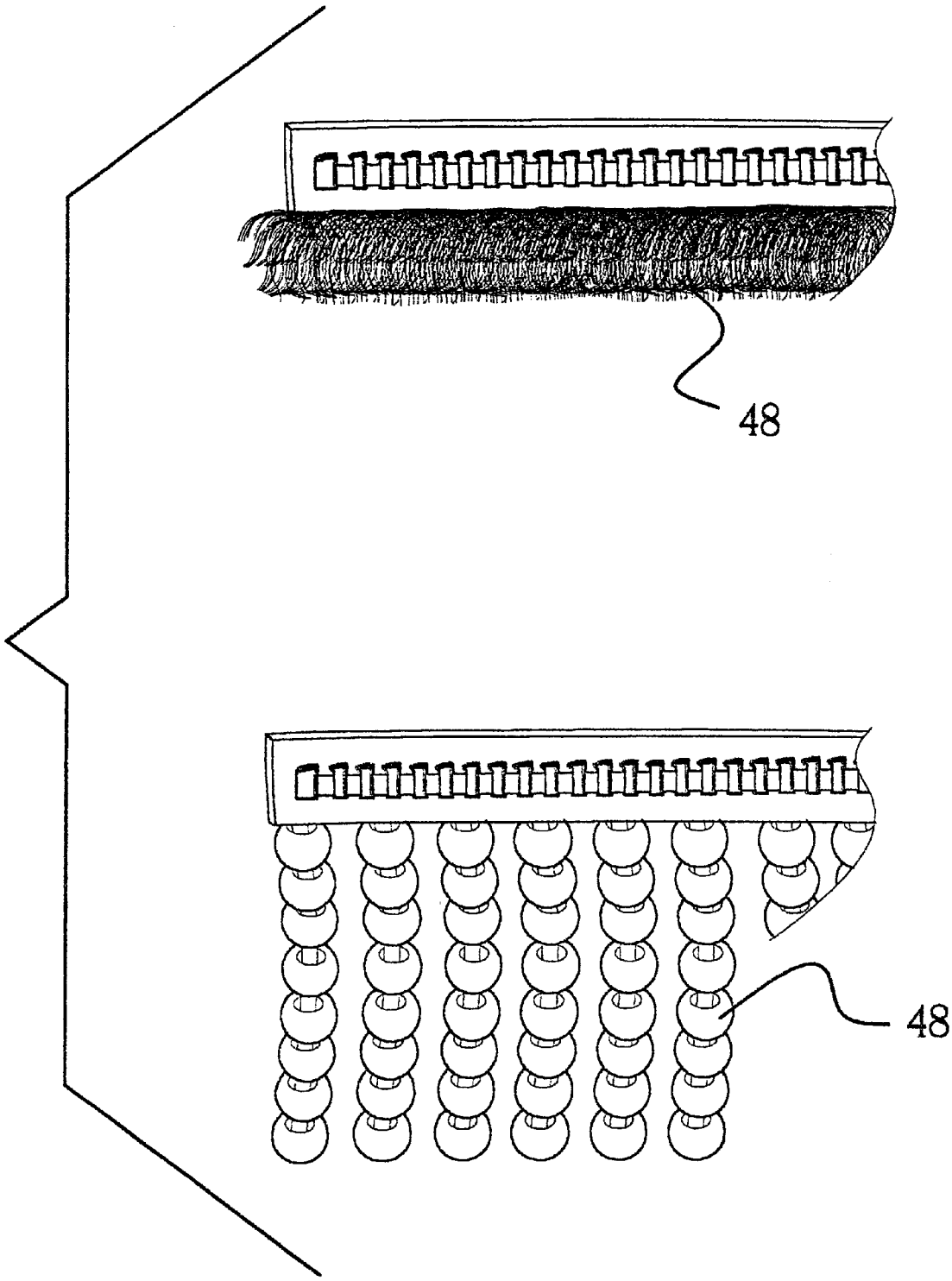
FIG. 4 is a schematic front view of braiding of the present invention.
Figure 5:
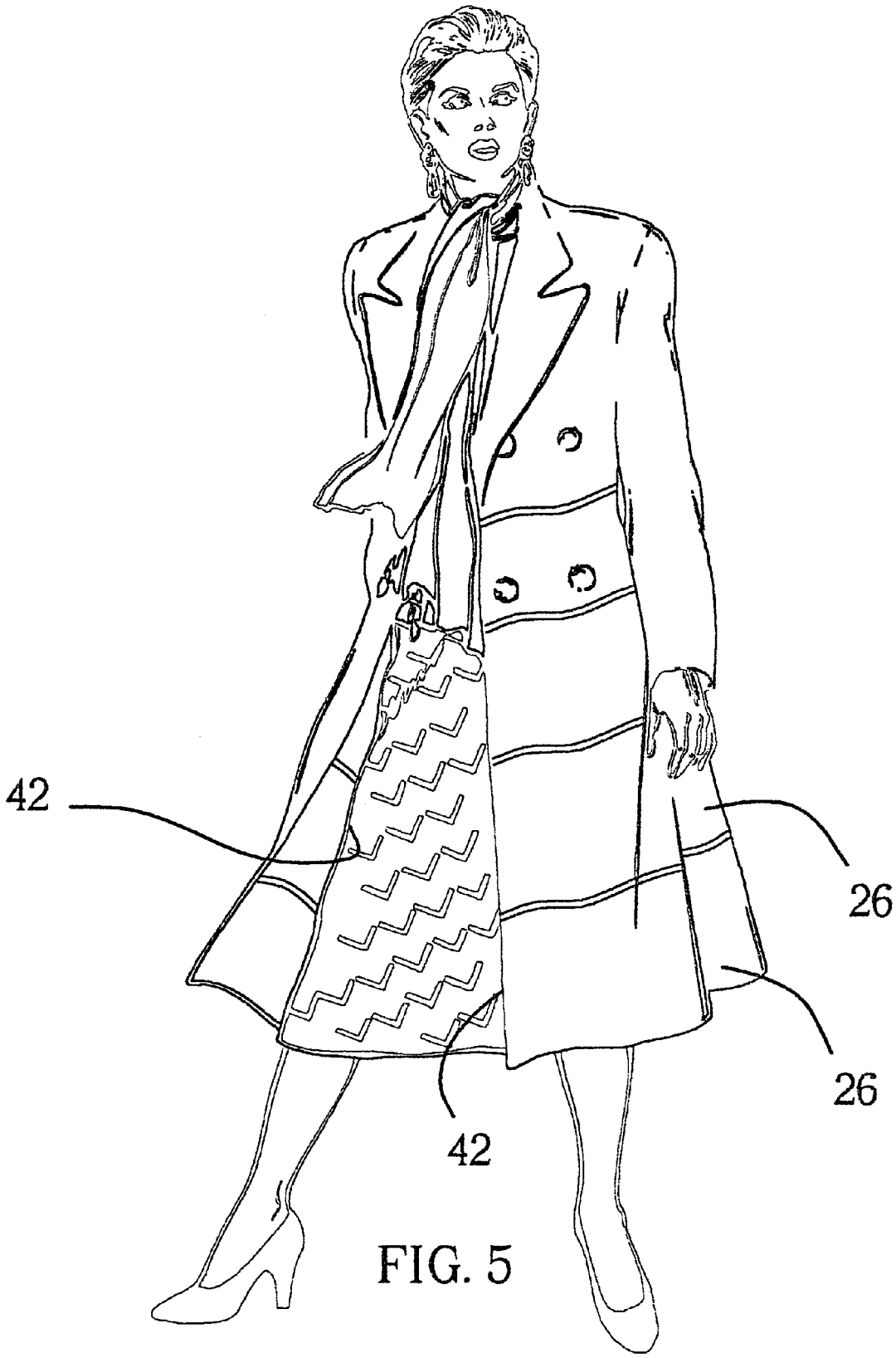
FIG. 5 is a schematic perspective view of the present invention.
Figure 6:
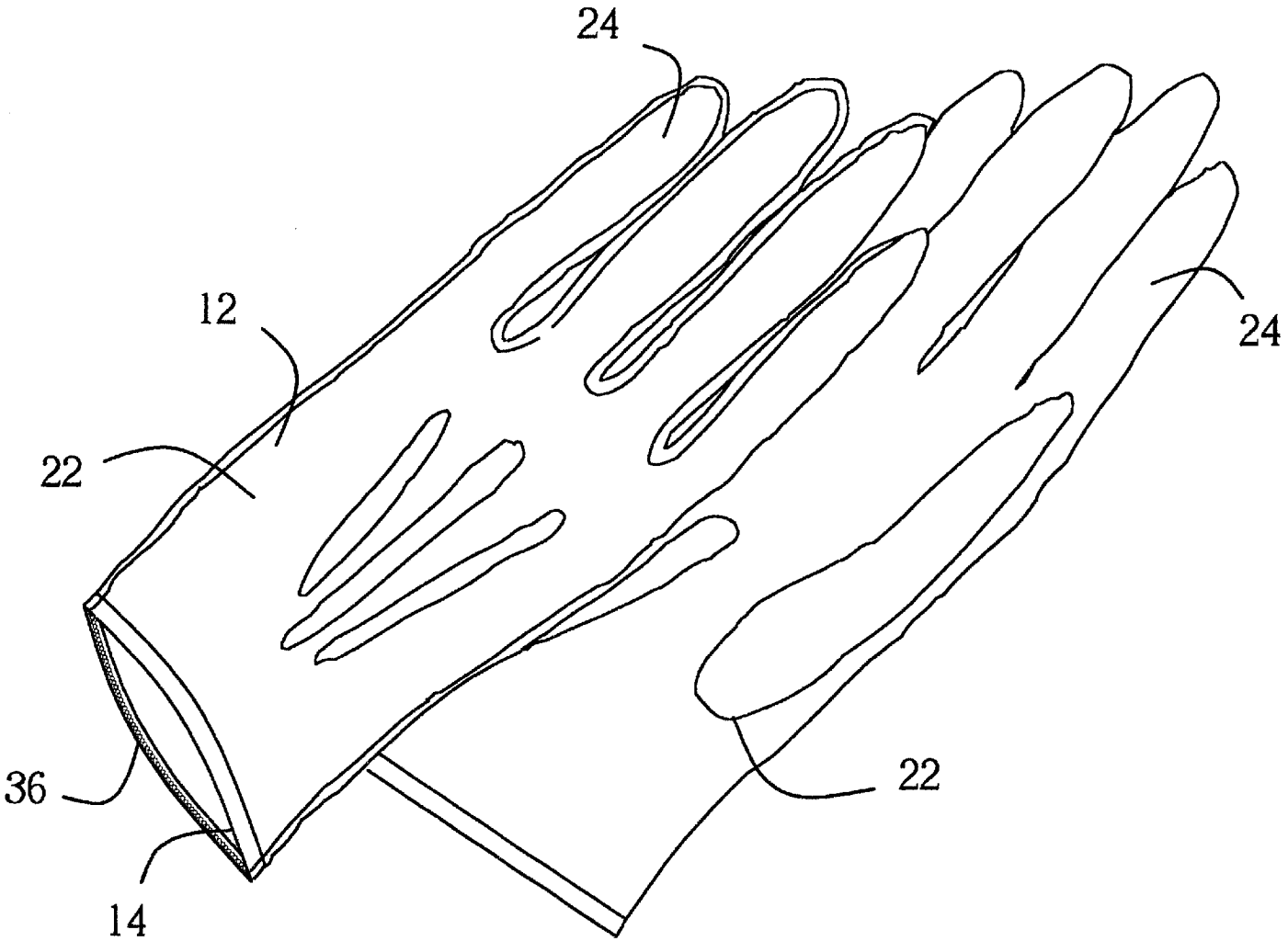
FIG. 6 is a schematic perspective view of the second embodiment of the present invention.
Figure 7:
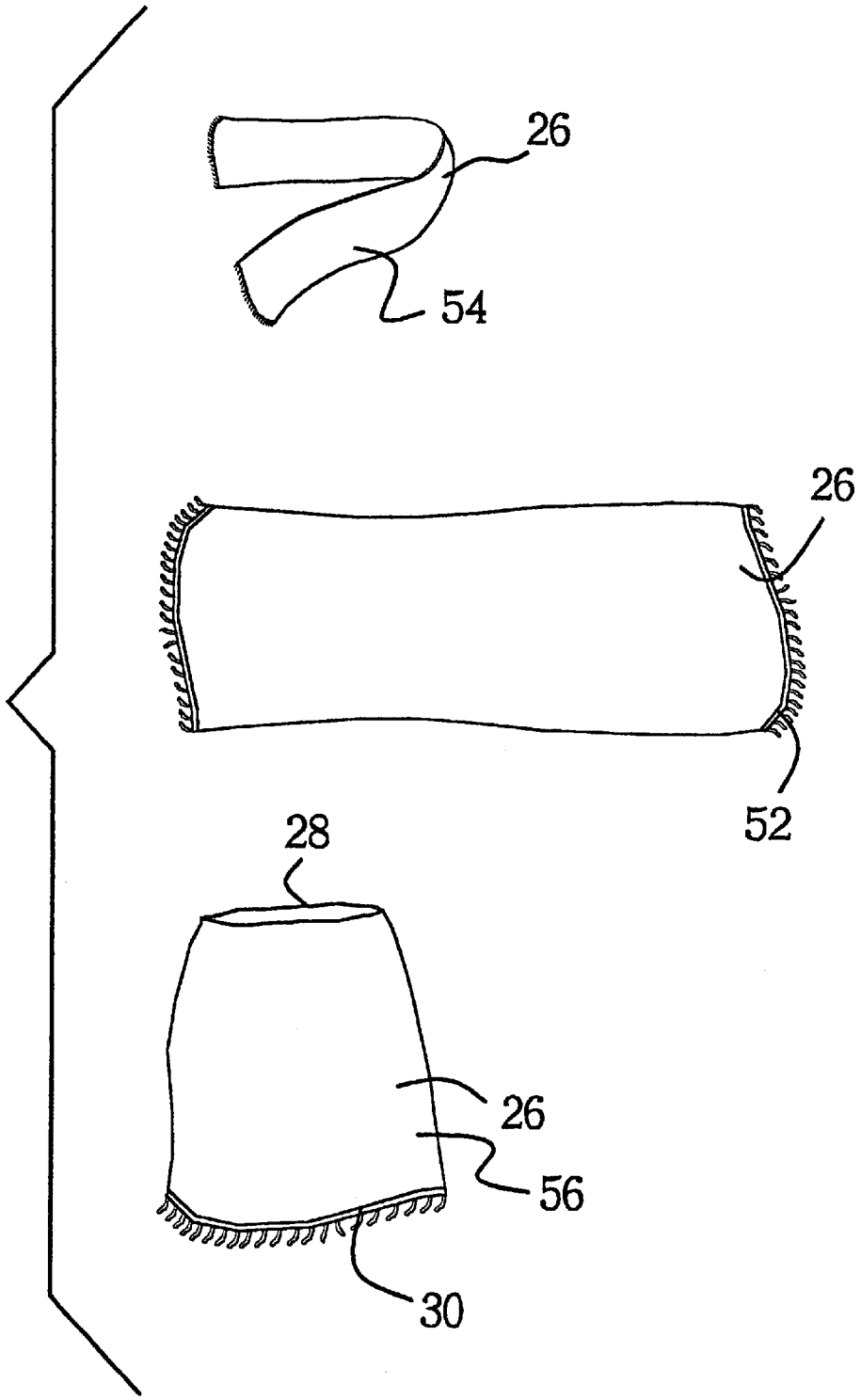
FIG. 7 is a schematic front perspective view panels of the present invention.

Each of a plurality of braids 48 each has a top edge 50 having a first zipper portion 34 coupled thereto and extending along the length of the braids 48. Each of the braids 48 is removably securably to one of the second edges 30 or the bottom edge 14. Different braids 48 and panels 26 are shown in FIGS. 3, 4 and 7. The braids 48 allow a wearer to change the overall look of the garment 10. As shown in FIG. 7, the braids may be positioned on other types of panels such as shawls 52, scarves 54 or skirts 56. The braids may also include fur, beads and other items conventionally used for braids.

In use, the invention allows the wearer extend the length of their garments 10, be it a dress, gloves, sleeves or any other area of a garment. The zippers are used to couple the various portions together. The braids may be attached to any of the various edges for changing the look of the article.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An extendable garment apparatus comprising:

a main covering, said main covering having a bottom edge;

a plurality of braids, each of said braids having a top edge having a coupling member therein for selectively coupling one of said braids to said bottom edge;

a plurality of panels, each of said panels being generally tubular shaped and having a first edge and a second edge;

a plurality of connectors for selectively connecting each of said first edges to said bottom edge of said main covering, said second edge of said panels or along a length of said braids, wherein a first of said panels is coupled to said bottom edge of said main body and a plurality of panels being coupled to each other and to said first panel to extend a length of the garment; and each of said connectors traversing around each of said first edges, second edges and bottom edge, each of said connectors comprising a first zipper portion and a second zipper portion, each of the first zipper portions being securely coupled to and extending along one of said first edges, and a length of said braids, each of said second zipper portions being securely coupled to and extending along one of said second edges and said bottom edge, each of said first zipper portions having a tab thereon for releasably joining the first zipper portion to one of said second zipper portions, each of said first zipper portions being securely attached to one of said first edges of said panels, wherein a first of said panels is coupled to said bottom edge of said main covering and a plurality of panels being coupled to each other and to said first panel to extend a length of the garment, a portion of said panels having a break therein extending between said first and second edges.

2. The extendable garment apparatus as in claim 1, wherein said main covering defines a torso portion having a neck opening and a pair of arm openings, said main covering abutting said bottom edge.

3. The extendable garment apparatus as in claim 1, further including:

a plurality of lips each being coupled to an inner surface of one of said panels and said main covering, each of said lips being adjacent to and extending along said second zipper portions and substantially covering an inner surface of said second zipper portions.

* * * * *